United States Patent [19]

Bucher

[11] 4,034,782

[45] July 12, 1977

[54] CONNECTING MEMBER FOR SECURING PULL ELEMENTS TO LIFTING WIRES OF A JACQUARD MACHINE

[75] Inventor: Robert Bucher, Winterthur, Switzerland

[73] Assignee: Sulzer Brothers Limited, Winterthur, Switzerland

[21] Appl. No.: 654,783

[22] Filed: Feb. 3, 1976

[30] Foreign Application Priority Data

Feb. 7, 1975 Switzerland ..... 1517/75

[51] Int. Cl.[2] ..... D03C 3/00; D03C 3/40

[52] U.S. Cl. ..... 139/85; 139/59; 24/237; 403/289; 403/301

[58] Field of Search ..... 139/85, 90, 88, 59, 139/60, 84; 403/289, 290, 301, 302, 19; 24/237

[56] References Cited

U.S. PATENT DOCUMENTS

| | | | |
|---|---|---|---|
| 510,752 | 12/1893 | Woodhead | 139/85 |
| 1,642,314 | 9/1927 | Stecke | 403/301 X |
| 1,861,363 | 5/1932 | Scheuner | 403/290 X |
| 2,216,344 | 10/1940 | Hampton | 403/301 X |
| 2,832,943 | 4/1958 | Cutler | 403/289 X |
| 3,055,400 | 9/1962 | Frappe | 139/85 |
| 3,295,812 | 1/1967 | Schneider et al. | 403/289 X |
| 3,533,184 | 10/1970 | Kerr | 24/237 X |
| 3,736,962 | 6/1973 | Rademacher | 139/85 |
| 3,747,647 | 7/1973 | Bergmann | 139/59 |

FOREIGN PATENT DOCUMENTS

| | | | |
|---|---|---|---|
| 62,065 | 11/1926 | Sweden | 139/88 |
| 1,260,029 | 1/1972 | United Kingdom | 139/60 |

*Primary Examiner*—James Kee Chi
*Attorney, Agent, or Firm*—Kenyon & Kenyon, Reilly, Carr & Chapin

[57] ABSTRACT

The connecting members are each made to receive a lifting wire in snap-fit manner at one end while receiving a knot or widened head of a harness cord or a distribution stirrup at the other end. The connecting members allow the harness cords to be readily connected to a lifting wire. The connecting members each have a clip-like part which may either engage in a recess of the lifting wire or may have a plurality of longitudinally spaced recesses to receive a collar of a lifting wire in one of the recesses. A spring may also be used in the connecting member to effect engagement.

17 Claims, 11 Drawing Figures

Fig. 2
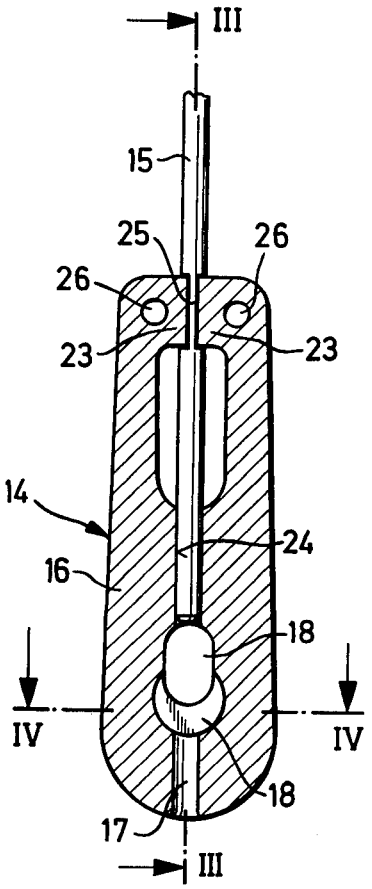
Fig. 3
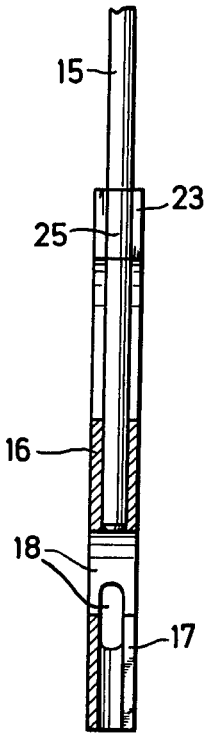
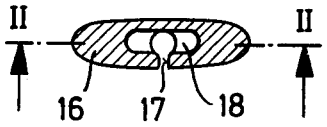
Fig. 4

CONNECTING MEMBER FOR SECURING PULL ELEMENTS TO LIFTING WIRES OF A JACQUARD MACHINE

This invention relates to a connecting member for securing pull elements to lifting wires of a jacquard machine.

As is known, conventional jacquard machines employ various types of lifting wires or hooks which have an intermediate hook or neb to which harness cords are secured by means of a loop and knot. In some cases, a protective cover may be pushed over the knot. However, complicated procedures have usually been required in order to obtain the correct length for each harness cord (equalization). Further, elaborate procedures have usually been performed when individual cords have to be released and, for example, hung on adjacent lifting wires.

Accordingly, it is an object of the invention to provide a simplified means for securing a lifting wire to a harness cord.

It is another object of the invention to provide a simple connecting member for securing a harness cord or the like to a lifting wire of a jacquard machine.

It is another object of the invention to effect a snap-fit connection between a lifting wire and a pull element such as harness cord or a distribution stirrup for controlling at least one warp yarn of a weaving machine.

Briefly, the invention provides a means for securing a pull element for controlling at least one warp yarn of a weaving machine to a lifting wire of a jacquard machine wherein the means is resiliently connected to the lifting wire in snap-fit manner. This means is in the form of a connecting member which has a recess at one end for receiving the pull element and means at an opposite end for forming a resilient snap fit connection with the lifting wire.

Because the connecting member forms a positive resilient snap-fit (i.e. push) connection with the lifting wire, the harness cord can then be connected to the lifting wire quite readily. Further, since the connection is resilient, the connection can be released whenever necessary.

Conveniently, the snap-fit connection is embodied by a pin-like free end on the lifting wire, such end being adapted to be pushed into a clip-like part of the connecting member. In one embodiment the connection contains a number of length adjustmemt notches or indents or recesses. This allows the complete length of the harness cord to be adjusted after the harness cord has been secured to the lifting wire (equalization).

In other embodiments, a spring is employed to effect the connection between the lifting wire and the connecting member.

In still another embodiment, a connecting member is used between a lifting wire and a distribution stirrup for a plurality of harness cords.

These and other objects and advantages of the invention will become more apparent from the following detailed description and appended claims taken in conjunction with the accompanying drawings in which:

FIG. 2 illustrates a detail of FIG. 1 in section and to an enlarged scale;

FIG. 3 illustrates a view taken on line III—III of FIG. 2;

FIG. 4 illustrates a view taken on line IV—IV of FIG. 2;

Figure 1:
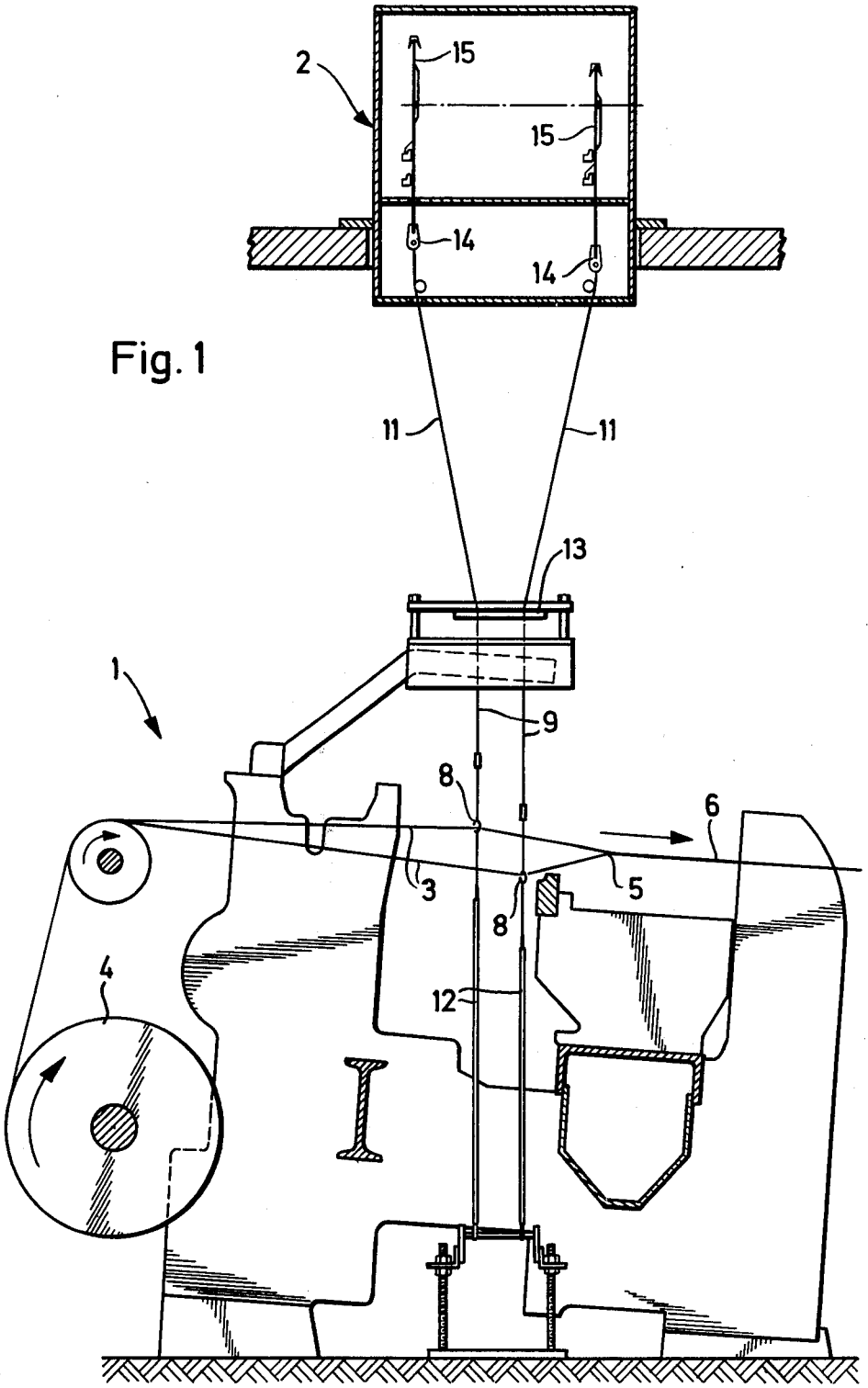
FIG. 1 illustrates a view in side elevation and in simplified form of a weaving machine having a jacquard machine using connecting member in accordance with the invention.

Referring to FIG. 1, a weaving machine 1 of known structure is disposed below a jacquard machine 2 for controlling warp yarns 3 of the weaving machine 1 — i.e. for moving the warp yarns 3 alternately into a top-shed position and a bottom-shed position. The yarns 3 run off a warp beam 4 and after beating-up at the shed apex 5 are worked up into a fabric 6.

The yarns 3 pass through eyes 8 of warp-yarn healds 9 which are suspended at their top on harness cords 11. Cords 12 of rubber of similar material serve to bias the healds 9 downwards.

At their top ends, the harness cords 11, which pass through a harness board 13, are secured by connecting members 14 to lifting wires 15 of the jacquard machine 2.

Referring to FIG. 2, each connecting member 14 is made in one piece of a resilient plastics, e.g. nylon and is formed at one end, i.e. the bottom 16 with a yard suspension slot 17. The slot 17 merges upwardly into a recess 18 into which a top knot 19 (FIG. 7) of a harness cord 11 can be introduced and retained. The harness cord 11 can have some other form of widened top end, such as head 21 as shown in FIGS. 5 and 6.

Referring in FIG. 2, each lifting wire 15 has a pin-like free end at the lower end as viewed whereas, each connecting member 14 has a clip-like part 23 at the upper end formed by a pair of opposed jaws and a passage 24 into which the bottom end of the lifting wire 15 can be pushed. The end of the lifting wire 15 has a constriction 25 formed by recesses, grooves or the like in which the jaws of the clip-like part 23 engage. The connection formed between the lifting wire 15 and the clip-like part 23 of the connecting member 14 is a positive resilient clamped connection.

A special tool, such as pliers, can be introduced into passages or apertures 26 in the jaws of the clip-like part 23 to expand the jaws at the top member 16 when required to disengage the wire 15 and member 16 from one another.

Figure 6:
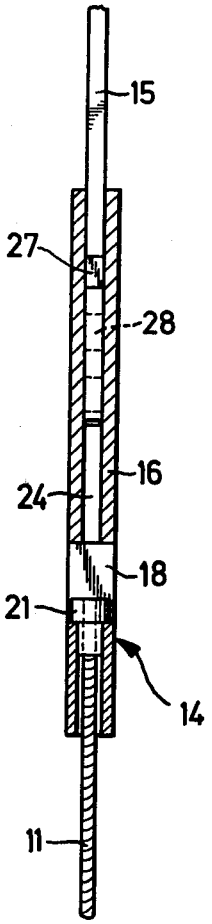
FIG. 6 illustrates a view taken on line VI—VI of FIG. 5.
Figure 5:
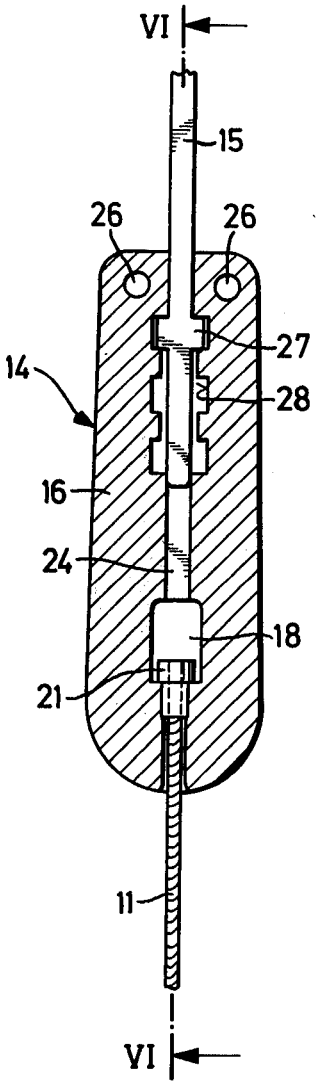
FIG. 5 illustrates a cross-sectional view corresponding to FIG. 2 of a modified connecting member according to the invention.

Referring to FIGS. 5 and 6, wherein like reference characters indicate like parts as above, the lifting wire 15 may alternatively have a collar 27 while the connecting member 14 is provided with a plurality of recessed portions 28 in the form of notches, indents or the like. The collar 27 can be selectively engaged in any one of the recessed portions 28 to vary the length of the connection.

Figure 7:
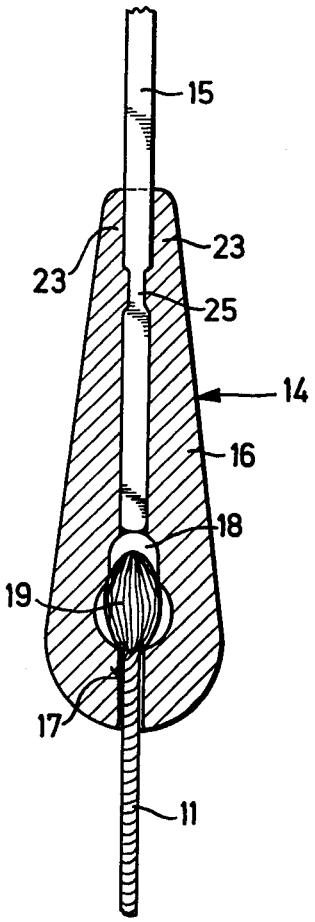
FIG. 7 illustrates a cross-sectional view of another modified connecting member according to the invention.

Referring to FIG. 7, wherein like reference characters indicate like parts as above, the clip-like part 23 of the connecting member 14 may be formed with a pair of opposed projections which are chamfered to fit into similarly chamfered recesses of the lifting wire 15. In this way, the lifting wire 15 may be disengaged from the passage in the connecting member 14 just by being given a strong pull to open the jaws of the part 23.

Figure 8:
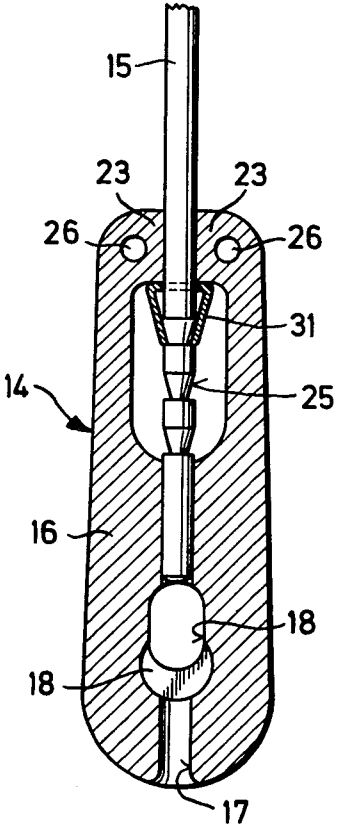
FIG. 8 illustrates a cross-sectional view of a modified connecting member wherein a spring on the lifting wire is employed in accordance with the invention.

Referring in FIG. 8, a spring 31 is placed on top of one of the recesses 25 of the wire 15 and the jaws of the clip-like part 23 of the connecting member 14 engage resiliently over the spring 31. In order to lengthen the connection, the spring 31 is introduced into a different recess 25, if necessary after opening up the jaws of the clip-like part 23.

Figure 9:
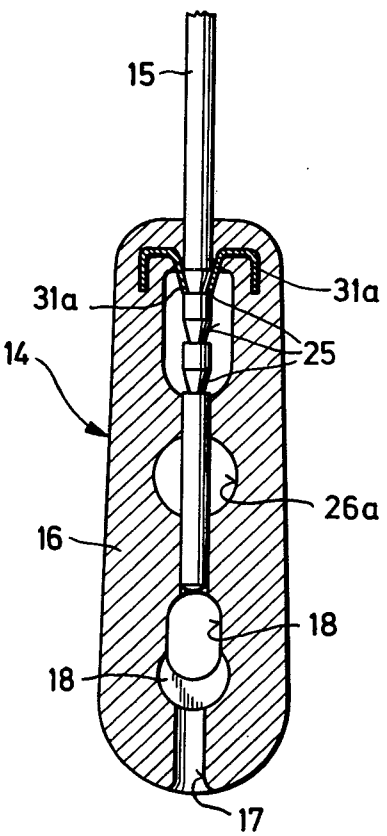
FIG. 9 illustrates a cross-sectional view of a modified connecting member employing a spring in accordance with the invention.

Referring to FIG. 9, a spring 31*a* may be integrally mounted in the connecting member 14 to selectively engage with a recessed or serrated wire 15. As shown, the connecting member 14 may alternatively be formed with an intermediate passage 26*a* which is adapted to receive an instrument to open up the clip-like part 23.

Figure 10:
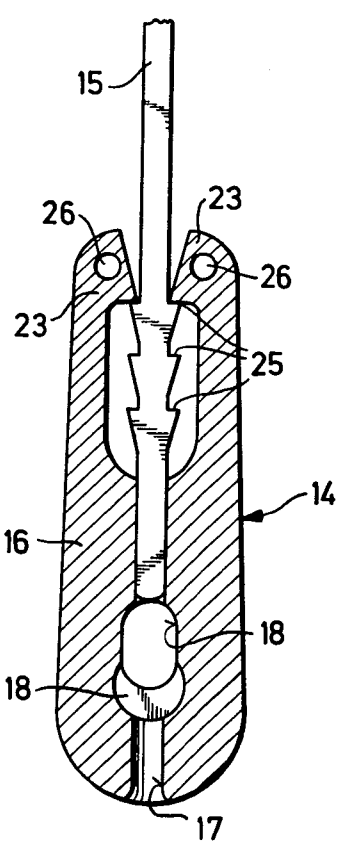
FIG. 10 illustrates a cross-sectional view of a further modified connection in accordance with the invention.

Referring to FIG. 10, the resilient jaws of the clip-like part 23 may alternatively engage directly over one of the serrations 25 of the lifting wire 15.

Figure 11:
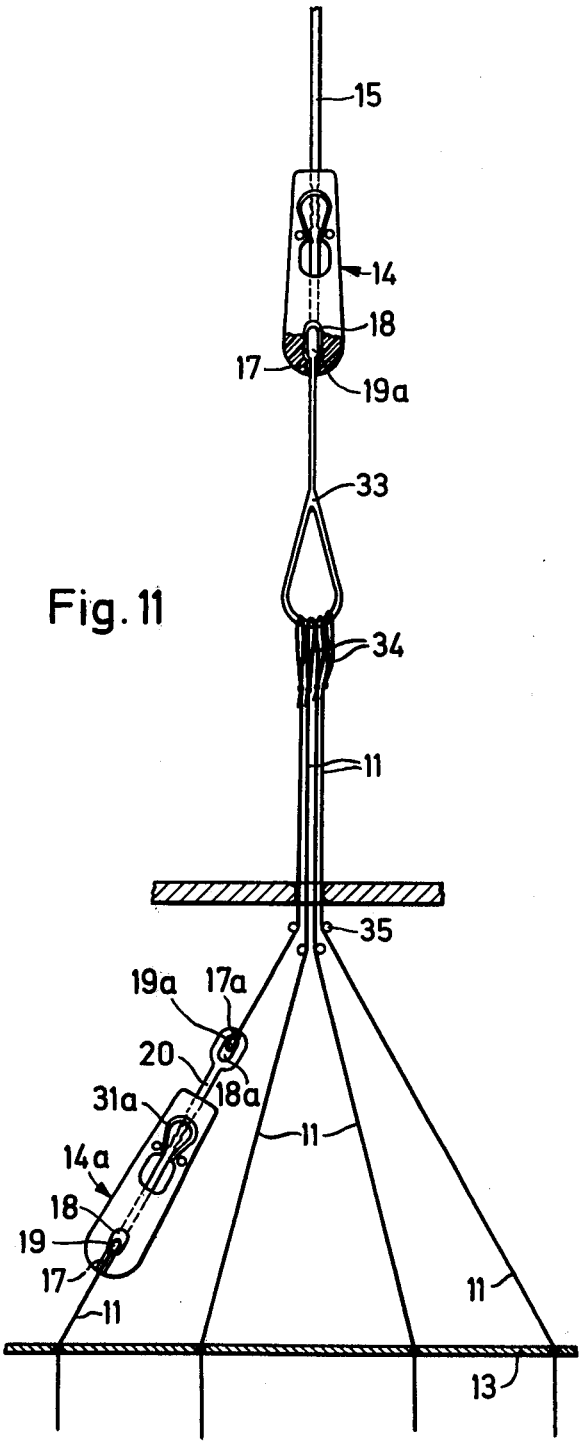
FIG. 11 illustrates a view of a connection employed between a distribution stirrup and a lifting wire in accordance with the invention.

As shown in FIG. 1, the connecting member 14 serves to provide a direct connection of the lifting wires 15 to the harness cords 11. However, in the embodiment shown in FIG. 11, another pull element, in the form of a distribution stirrup 33 made e.g. of wire or the like is introduced upwardly into the slot 17 and recess 18 of the connecting member 14, which is basically similar to the member 14 of FIG. 9. The stirrup 33 has a widened head 19*a* at the top which is received in the recess 18 of the connecting member 14. The harness cords 11 are introduced, with the formation of loops 34 into the stirrup 33 and extend through a harness board 13 by way of deflecting rods 35. In the area between the rods 35 and the board 13, each harness cord 11 is made of two parts and has a coupling 14*a* corresponding to the connecting member 14 to couple the parts together. Thus, in a similar manner to the bottom part, the top part of the cord 11 is secured in a snap-fit push-in intermediate element 20 formed with a slot 17*a* with a knot 19*a* received in an eye 18*a*.

By means of the upper connecting member 14, all the harness cords 11 received in a single stirrup 33 can be adjusted lengthwise simultaneously, while the intermediate couplings 14*a* can be used to provide individual adjustmemt of each harness cord 11.

The connecting member 14 is of use particularly with the single lifting wires (one-armed lifting wires) 15 as shown. However, the member is also of use for double lifting wires (two-armed lifting wires) if these wires have a pin-like end e.g. at the bottom. The connecting member 14 is usually a flat device with its flatness extending parallel to the plane of the drawings.

The connecting member 14 can also be made of metal.

What is claimed is:

1. In combination, a lifting wire of a jacquard machine;

a pull element for controlling at least one warp yarn of a weaving machine; and means for securing said pull element to said lifting wire, said means having a clip-like part at one end resiliently connected to said lifting wire in snap-fit clamped manner and a slot at an opposite end receiving said pull element for suspension therefrom.

2. The combination as set forth in claim 1 wherein said lifting wire includes a pin-like free end received in said clip-like part.

3. The combination as set forth in claim 2 wherein at least one of said free end and said clip-like part includes at least one recessed portion and the other of said free end and said clip-like part is received therein.

4. The combination as set forth in claim 2 wherein at least one of said free end and said clip-like part includes a plurality of longitudinally spaced recessed portions and the other is received in one of said recessed portions.

5. The combination as set forth in claim 4 wherein said lifting wire free end has a plurality of said recesses therein.

6. The combination as set forth in claim 5 which further includes a spring interposed between said one of said recesses and said clip-like part.

7. The combination as set forth in claim 6 wherein said spring is mounted on said free end in a selective one of said recesses.

8. The combination as set forth in claim 6 wherein said spring is integrally mounted in said clip-like part.

9. The combination as set forth in claim 2 wherein said clip-like part includes passages therein to receive a tool for expanding said part to disengage said lifting wire free end.

10. The combination as set forth in claim 1 wherein said means includes a recess adjacent said slot and said pull element includes a widened head received in said recess.

11. The combinaton as set forth in claim 1 wherein said pull element is a distribution stirrup for a plurality of harness cords and wherein each harness cord includes one of said means intermediately thereof for adjusting the length of said respective harness cord.

12. A connecting member having a slot and a recess merging into said slot near one end to receive a pull element for controlling at least one warp yarn of a weaving machine and a clip-like part having a pair of opposed jaws and a passage for a lifting wire at an opposite end for forming a resilient snap-fit connection with a lifting wire of a jacquard machine inserted between said jaws.

13. A connecting member as set forth in claim 12 wherein said clip-like part includes a pair of oppositely disposed projections for engaging a recessed lifting wire.

14. A connecting member as set forth in claim 12 wherein said jaws have a plurality of longitudinally spaced recesses for selectively engaging a lifting wire.

15. A connecting member as set forth in claim 12 which further includes a spring mounted between said jaws to engage a recessed lifting wire.

16. A connecting member as set forth in claim 12 which further includes at least one passage for receiving a tool to expand said clip-like part.

17. A connecting member as set forth in claim 12 made of one-piece construction.

* * * * *